US005968717A

United States Patent [19]

Wildman

[11] Patent Number: 5,968,717

[45] Date of Patent: Oct. 19, 1999

[54] PROCESS AND APPARATUS FOR THE REDOX DEVELOPMENT OF PHOTOGRAPHIC MATERIALS

[75] Inventor: Nigel Richard Wildman, Watford, United Kingdom

[73] Assignee: Eastman Kodak Company, Rochester, N.Y.

[21] Appl. No.: 09/034,675

[22] Filed: Mar. 4, 1998

[30] Foreign Application Priority Data

Mar. 4, 1997 [GB] United Kingdom ..... 9700439

[51] Int. Cl.[6] ..... G03C 7/42

[52] U.S. Cl. ..... 430/373; 430/414; 430/943

[58] Field of Search ..... 430/373, 414, 430/430, 461, 943

[56] References Cited

U.S. PATENT DOCUMENTS 5,315,338 5/1994 Frank et al. ..... 354/320

5,766,831 6/1998 Wildman ..... 430/373

FOREIGN PATENT DOCUMENTS

0793141A2 1/1997 European Pat. Off. .

1 482 080 10/1973 United Kingdom .

2 303 930 3/1997 United Kingdom .

*Primary Examiner*—Hoa Van Le

*Attorney, Agent, or Firm*—J. Lanny Tucker

[57] ABSTRACT

A process for forming a photographic image includes a color development step and a combined bleach/redox amplification step. The bleach amplification step is effected by applying to the surface of the photographic paper or other material an amount of bleach/redox amplifier solution in the range from 20 to 500 ml/m$^2$. The solution applied to the surface is used once only and contains hydrogen peroxide or a peroxide releasing compound.

19 Claims, 1 Drawing Sheet

PROCESS AND APPARATUS FOR THE REDOX DEVELOPMENT OF PHOTOGRAPHIC MATERIALS

FIELD OF THE INVENTION

This invention relates to a process wherein a photographic color image is formed by the redox amplification process. In particular, this invention relates to processing photographic materials in a color developer followed by a combined amplification and bleaching step, and to an apparatus in which the combined amplification and bleaching may be carried out.

BACKGROUND OF THE INVENTION

Redox amplification processes have been described, for example in GB Publications 1,268,126; 1,399,481; 1,403,418; and 1,560,572. In such processes color materials are developed to produce a silver image (which may contain only small amounts of silver) and treated with a redox amplifying solution (or a combined developer/amplifier) to form a dye image.

The developer-amplifier solution contains a color developing agent and an oxidizing agent that will oxidize the color developing agent in the presence of the silver image which acts as a catalyst.

Oxidized color developer reacts with a color coupler to form the dye image. The amount of dye formed depends on the time of treatment or the availability of the color coupler and is less dependent on the amount of silver in the image than is the case in conventional color development processes.

Examples of suitable oxidizing agents include peroxy compounds including hydrogen peroxide and compounds that provide hydrogen peroxide, e.g., addition compounds of hydrogen peroxide such as perborates and addition compounds of hydrogen peroxide with urea. Other oxidizing agents include cobalt (III) complexes including cobalt hexammine complexes; and periodates. Mixtures of such compounds can also be used.

The image-forming step can be followed by a stop bath, bleach and fix step, although the bleach and/or fix may be omitted if the silver coating weight of the material processed is low enough. When a bleach-fix is employed after redox amplification, the solution needs only small amounts of oxidizing agent such as iron (III) and fixing agent such as thiosulfate because there is only a small amount of silver to remove.

Recently it has been proposed that the bleach bath may contain a peroxide as sole bleaching agent. Such proposals have carried the warning that, at low pH levels, redox amplification should be stopped before bleaching otherwise there is a risk that color staining may occur due to image formation continuing in the peroxide bleach solution.

GB-2303930A describes a process in which a development step is followed by a bleach amplifier step. In this process at least 50% of the dye image is formed from the carryover of color developing agent from the developer solution to the beach amplifier bath. The bleach amplifier is of limited stability at pH ranges of 9.0 to 12.0 and decomposition of hydrogen peroxide occurs, eventually leading to loss of amplification. For example, during overnight standing the seasoned bleach amplifier will sometimes decompose and will then be unsuitable for further processing because of the risk of forming a yellow stain (not a dye stain) on the photographic material being processed.

SUMMARY OF THE INVENTION

According to the present invention there is provided a process for forming a photographic image comprising the steps of:

A) color developing an imagewise exposed photographic material, and

B) combined bleaching and redox amplification of the photographic material, wherein step B is carried out with a sample of a bleach/redox amplifying solution comprising hydrogen peroxide or a compound that releases hydrogen peroxide, the sample being applied only once to the photographic material in an amount of from about 20 to about 500 ml/m$^2$.

The present invention provides a solution to the problem noted above by the provision of a process in which, after a development step, a small volume or sample of bleach/redox amplifier solution is applied to the surface of the photographic paper or other material being processed, and that sample is used once only.

This avoids the problem caused by seasoning of the bleach/redox amplifier solution and therefore makes the bleach/redox amplifier step more manageable.

By "used once only" we mean there is no recycle of the bleach/redox amplifier solution to the bleach/redox amplification bath. The used bleach/redox amplifier solution may be conveniently discarded.

DETAILED DESCRIPTION OF THE INVENTION

Figure 1:
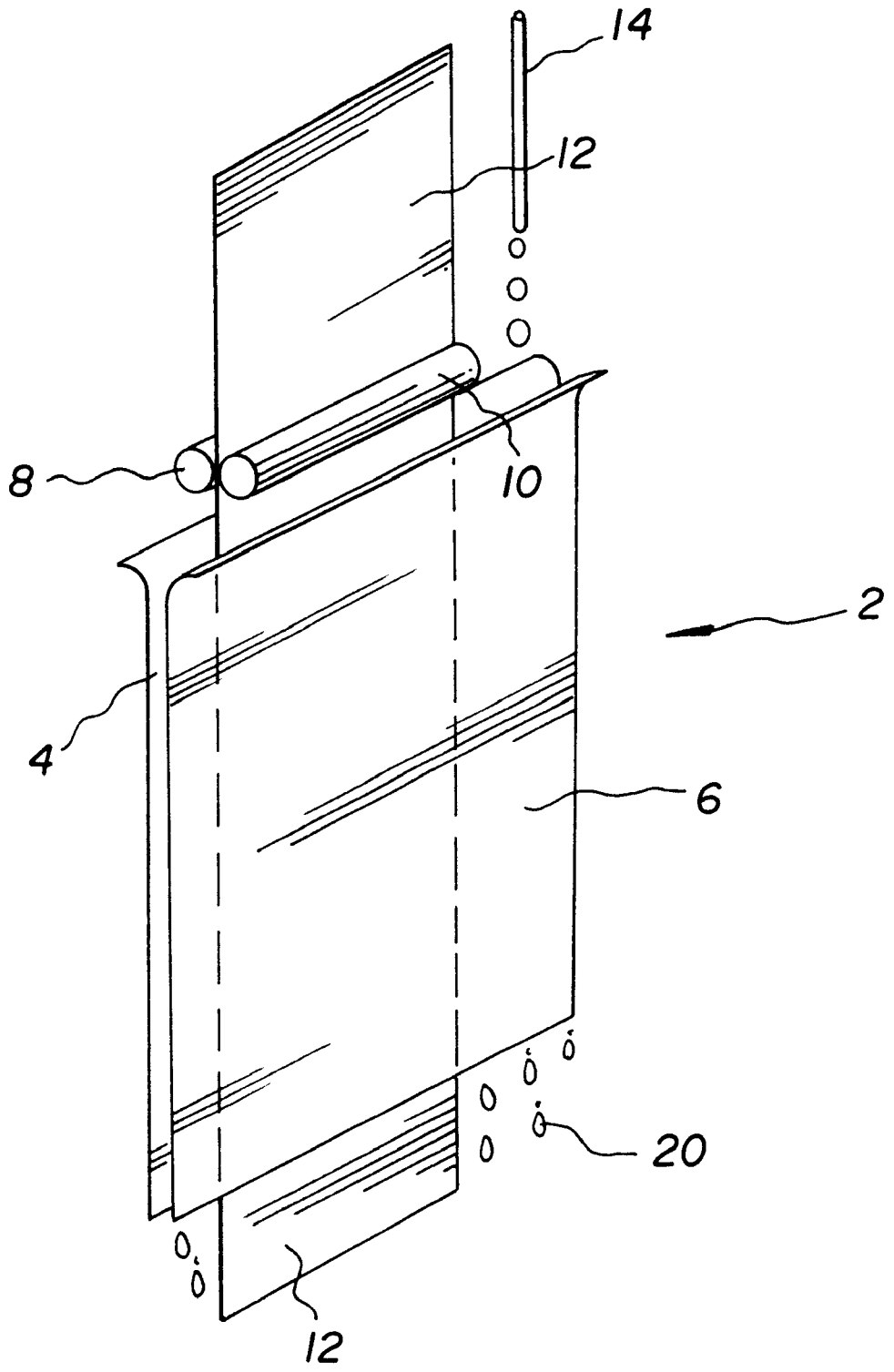
FIG. 1 is a perspective view of an apparatus useful in the bleach/redox amplification step of the present invention.

The present invention uses a color developer solution and a combined bleach/redox amplification solution. In such a process, the dye image is formed because color developing agent is carried into the bleach/redox amplifier solution from the color developer solution in which the catalytic image silver has been previously formed. The bleach/redox amplifier solution provides the desired amplification and rehalogenates the image silver.

In such a process at least 65%, and often at least 70%, of the dye image may be formed in the bleach/redox amplifier solution.

Silver halide can then be removed, if desired, by fixing to leave only the dye image. Such a fixer may contain a thiosulfate or sulfite fixing agent.

The combined bleach/redox amplifier solution preferably has a pH in the range from about 10 to about 12, especially in the range from about 10.5 to about 11.2, and particularly from about 10.8 to about 11.1.

The alkaline agent may comprise an alkali metal carbonate or preferably phosphate buffer with optional use of an alkali metal hydroxide.

The combined bleach/redox amplifier solution preferably contains from about 6 to about 100 ml/l of hydrogen peroxide (30 w/w aqueous solution), and preferably from about 10 to about 50 ml/l.

The combined bleach/redox amplifier solution preferably contains a halide in amounts of from about 1 to about 35 g/l (as potassium chloride). The preferred halide is chloride.

It is preferred to use a fixer in a fixing step after the bleach/redox amplification step. If used, the fixer may comprise hypo or can comprise an alkali metal sulfite as sole fixing agent.

Any useful color developing agent can be used in the invention. Preferred color developing agents are:

4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride, and 4-amino-N-ethyl-N-(2-methoxy-ethyl)-m-toluidene di-p-toluene sulfonate.

The color developer solutions may contain antioxidants, such as hydrazines, hydroxylamines, hydroxyamic acids, oximes, nitroxy radicals, phenols, saccharides, monoamines, diamines, tertiary amines, polyamines, quaternary ammonium salts, alpha hydroxy ketones, alcohols, diamides and disulfonamides.

Suitable antioxidants are described in EP-A-0 410 375. The preferred antioxidants are substituted or unsubstituted hydroxylamine compounds.

The bleach/redox amplifier solution may contain a hydrogen peroxide stabilizer, for example pentetic acid (diethylenetriamine pentaacetic acid) or dipicolinic acid.

Pentetic acid is preferably used in the range of from about 0.3 to about 1.5 g/l, and preferably from about 0.5 to about 1.0 g/l.

The bleach/redox amplifier solution may also contain a surfactant to wet the surface of the photographic paper of other material being processed such as a nonionic surfactant, e.g., an ethoxylated octyl or nonyl phenol at concentrations of, for example, from about 0.1 to about 0.6 g/l.

A particular application of the present invention is for the processing of silver chloride color paper, for example a color paper comprising at least about 85 mol % of silver chloride, and especially such color paper with low silver levels, for example below about 130 mg/m$^2$, e.g., from about 20 to about 120 mg/m$^2$, preferably below about 100 mg/m$^2$, and particularly in the range of from about 20 to about 100 mg/m$^2$.

Within these total ranges the blue sensitive emulsion layer unit may comprise from about 20 to about 60 mg/m$^2$, preferably from about 25 to about 50 mg/m$^2$ with the remaining silver divided between the red and green sensitive layer units, preferably more or less equally between the red and green sensitive layer units.

The photographic materials can be single color elements or multicolor elements. Multicolor elements contain dye image-forming units sensitive to each of the three primary regions of the spectrum. Each unit can be comprised of a single emulsion layer or of a multiple emulsion layer sensitive to a given region of the spectrum. The layers of the element including the layers of the image-forming units, can be arranged in various orders as known in the art. In an alternative format, the emulsions sensitive to each of the three primary regions of the spectrum can be disposed as a single segmented layer.

A typical multicolor photographic material comprises a support bearing a cyan dye image forming unit comprised of at least one red-sensitive silver halide emulsion layer having associated therewith at least one cyan dye forming coupler, a magenta dye image forming unit comprising at least one green sensitive silver halide emulsion layer having associated therewith at least one magenta dye forming coupler, and a yellow dye image forming unit comprising at least one blue sensitive silver halide emulsion layer having associated therewith at least one yellow dye forming coupler. The element can contain additional layers such as filter layers interlayers, overcoat layers, subbing layers and the like.

Suitable materials for use in this invention (and their components) can be any of the materials described in Research Disclosure Item 36544, September 1994, published by Kenneth Mason Publications, Emsworth, Hants PO 10 7DQ United Kingdom.

According to another aspect of the present invention there is provided an apparatus for photographic processing comprising:

(i) a pair of generally parallel sheets having a close space between them, (ii) means for feeding a photographic material between the pair of sheets, and (iii) means for feeding a bleach/redox amplifying solution to the close space between the pair of sheets.

Preferably the sheets are thin and are held apart near their upper edges to facilitate entry of the photographic material into the gap between the sheets, and the gap between the sheets is such that in use the sheets are held together by the surface tension of the bleach/redox amplifier solution.

Preferably the upper ends of the sheets are flared outwardly so that when a photographic material is passed downwardly between the sheets and bleach/redox amplifier solution is fed to the gap between the sheets, a bead of bleach/redox amplifier solution collects in the trough formed by the outwardly flared ends.

Preferably the means for feeding the photographic material comprises a pair of rollers.

The sheets, that are conveniently made of a plastics material, for example polyethylene, polypropylene, polyvinyl chloride, acrylic polymer or polyester, are preferably flexible and textured, i.e., have some surface relief to facilitate the passage of the photographic paper or other material between them.

Referring to FIG. 1, apparatus 2 comprises a pair of spaced apart parallel sheets 4 and 6 and a pair of rollers 8 and 10 for feeding photographic paper 12 into the gap between the sheets and through the apparatus. The upper ends of parallel sheets 4 and 6 are flared outwardly to facilitate entry of the paper 12 and to form a small trough or reservoir for holding bleach/redox amplifier solution. Means for supplying bleach/redox amplifier solution is provided in the form of thin pipe 14 that drip feeds a sample of solution to the gap between the sheets. The sheets 4 and 6 are held apart at their upper end by means not shown, at a distance so that in use they are held together by the surface tension of the bleach/redox amplifier solution.

In use, photographic paper 12 is continuously fed to and passed downwardly through the apparatus. Bleach/redox amplifier solution is continuously fed dropwise to the gap between the sheets 4 and 6 at a rate of 50 ml/m$^2$ of photographic paper. A bead of solution (not shown) forms in the trough formed by the upper flared ends of the sheets. The paper is passed at a constant speed so that it is between the sheets for at least 5 seconds, and preferably at least 10 seconds. As paper 12 emerges from the lower end of sheets 4 and 6, used bleach/redox amplifier solution, shown as drops 20, is discarded.

The invention is illustrated by the following Examples, but is not to be limited thereto.

EXAMPLE 1

Continuous single use redox amplification solution.

Color Developer (Formula A)

| component | amount |
|---|---|
| anti-calcium agent | 0.6 g/l |
| pentetic acid | 0.81 g/l |
| $K_2HPO_4.3H_2O$ | 40.0 g/l |
| potassium chloride | 1 g/l |
| potassium bromide | 1 mg/1 |
| N,N-diethylhydroxylamine (85 w/w solution) | 9.0 ml/l |
| color developing agent (CD-3) | 8.0 g/l |
| pH | 11.4 |
| KOH (50%) | 11 ml/l |
| temperature | 35° C. |
| processing time | 25 seconds |

Bleach/redox amplifier solution (Formula B)

| component | amount |
|---|---|
| anti-calcium agent* | 0.6 g/l |
| pentetic acid* | 0.81 g/l |
| $K_2CO_3$ | 24.28 g/l |
| $H_2O_2$ (30% w/w solution) | 15 ml/l |
| potassium chloride | 2 g/l |
| pH | 10.9 |
| KOH (50% w/w solution) | to pH 10.9 |
| surfactant** | 1 ml/l |
| processing time | 10 seconds |
| temperature | 30 to 35° C. (not critical) |

Fixing Solution

C-41 Electrosilver fixer diluted 100 ml/l.

*indicates that these components can be left out of the solution if the buffer and hydrogen peroxide are kept separately and mixed just prior to processing.
**non ionic surfactant consisting of octyl phenol ethoxylated with 10 molecules of ethylene oxide.

Imagewise exposed photographic paper that had been developed in color developer solution A was introduced to the apparatus shown in FIG. 1 and fed between the sheets at a constant speed to provide a time for the paper between the sheets of at least 10 seconds. Bleach/redox amplifier solution B was dribbled into the gap between the sheets at a rate of 50 ml/$m^2$ of photographic paper. The bleach/redox amplifier solution contained an ethoxylated octyl phenol surfactant as wetting agent to assist in spreading the solution across the width of the sheets that were held together by the surface tension of the solution. The solution ran down between the sheets and dripped to waste at the bottom.

After leaving the apparatus the paper was subjected to a fixing step in the fixing solution as described above, and then washed and dried.

EXAMPLE 2

A color developer solution and a bleach/redox amplifier solution were prepared:

Color Developer Solution (Formula 1)

| component | amount |
|---|---|
| anti-calcium agent | 0.6 g/l |
| DTPA | 0.81 g/l |
| $K_2HPO_4.3H_2O$ | 40.0 g/l |
| potassium chloride | 1 g/l |
| potassium bromide | 1 mg/l |
| N,N-diethylhydroxylamine (85 w/w solution) | 12.0 ml/l |
| color developing agent | 10.0 g/l |
| pH | 11.4 |
| KOH (50%) | 11 ml/l |
| temperature | 35° C. |
| processing time | 25 seconds |

Bleach/redox Amplifier Solution(Formula 2)

| component | amount |
|---|---|
| anti-calcium agent | 0.6 g/l |
| DTPA | 0.81 g/l |
| $K_2HPO_4.3H_2O$ | 40.0 g/l |
| or 25 g/l of $K_2CO_3$ | |
| $H_2O_2$ (30% w/w solution) | 15 ml/l |
| potassium chloride | 5 g/l |
| pH | 11.4 |
| KOH (50%) | 15 ml/l |
| processing time | 25 seconds |
| Process cycle | |
| color develop with formula 1 | 25 seconds |
| bleach/redox amplify with formula 2 | 25 seconds |
| KODAK Electrosilver fixer (100 ml) | 30 seconds |
| wash | 120 seconds |
| dry | |

The anti-calcium agent is a 60% w/w aqueous solution of 1-hydroxyethylidene-1,1-diphosphonic acid.

DTPA is diethylene triamine pentaacetic acid.

The color developing agent (CD-3) is 4-N-ethyl-N-(b-methanesulfonamido-ethyl)-o-toluidene sesquisulfate.

Low silver photographic color paper (58 mg/$m^2$) was exposed by a standard test exposure and processed in Formulae 1 and 2 under the process conditions given above. The color papers were then read with status A sensitometry and the Dmax and Dmin values for the different solution conditions and times recorded in Table 1.

Bleach Amplifier Stability with Phosphate Buffer at pH 10.0

TABLE 1

| No | Solution | Cyan Dmax | Magenta Dmax | Yellow Dmax | Cyan Dmin | Magenta Dmin | Yellow Dmin |
|---|---|---|---|---|---|---|---|
| 1 | start | 2.26 | 2.19 | 2.08 | 0.105 | 0.113 | 0.105 |
| 2 | +40% vol developer | 2.6 | 2.54 | 2.5 | 0.107 | 0.123 | 0.111 |
| 3 | after 72 hrs. seasoned | 1.49 | 1.76 | 2.18 | 0.106 | 0.130 | 0.122 |
| 4 | after 72 hours fresh | 2.24 | 2.37 | 2.24 | 0.101 | 0.116 | 0.106 |

TABLE 1-continued

| No | Solution | Cyan Dmax | Magenta Dmax | Yellow Dmax | Cyan Dmin | Magenta Dmin | Yellow Dmin |
|---|---|---|---|---|---|---|---|
| 5 | adjust $H_2O_2$ and pH to aim | 2.37 | 2.42 | 2.31 | 0.111 | 0.134 | 0.145 |
| 6 | after 7.5 hrs. | 2.17 | 2.22 | 2.28 | 0.113 | 0.152 | 0.214 |
| 7 | 24 hrs. | 1.95 | 2.15 | 2.33 | 0.116 | 0.164 | 0.244 |

In the above Table 1, solution 2 that represents seasoned bleach amplifier, was prepared by making up solution 1 using 40% by volume of color developer of Formula 1 instead of water.

Solution 3 is the solution 2 but after 72 hours. Solution 4 is the solution 1 but after 72 hours.

Solution 5 is solution 3 whose pH and peroxide have been adjusted to those of Formula 2.

Solution 6 is solution 5 after 7.5 hours and solution 7 is solution 5 after 24 hours.

The results in Table 1 demonstrate the problem, namely the deterioration in properties of the bleach/redox amplifier solutions, that the present invention solves.

Comparing the values of any of solutions 2 to 7 with the values of solution 1, it is seen that the Dmax values (with the exception of those for solution 2) above fallen and the Dmin values have risen. This shows the instability of the bleach/redox amplifier solutions.

A similar experiment was run using carbonate as the buffer in Formula 2 and the results recorded in Table 2.

Bleach Amplifier Stability with Carbonate Buffer at pH 10.0

TABLE 2

| No | Solution | Cyan Dmax | Magenta Dmax | Yellow Dmax | Cyan Dmin | Magenta Dmin | Yellow Dmin |
|---|---|---|---|---|---|---|---|
| 1 | start | 2.22 | 2.35 | 2.26 | 0.09 | 0.107 | 0.09 |
| 2 | +40% developer | 2.64 | 2.5 | 2.41 | 0.134 | 0.174 | 0.143 |
| 3 | after 72 hrs. seasoned | 0.85 | 0.9 | 1.09 | 0.106 | 0.121 | 0.111 |
| 4 | after 72 hours fresh | 2.084 | 2.11 | 2.15 | 0.1 | 0.127 | 0.120 |
| 5 | adjust $H_2O_2$ and pH to aim | 2.07 | 2.05 | 2.24 | 0.102 | 0.13 | 0.137 |
| 6 | after 7.5 hrs. | 1.82 | 2.02 | 2.34 | 0.107 | 0.146 | 0.194 |
| 7 | 24 hrs. | 1.52 | 1.65 | 2.1 | 0.10 | 0.133 | 0.159 |

In Table 2 solution 3 was solution 2 after 72 hours. Solution 4 was the solution 1 after 72 hours and the solution 5 was the solution 3 whose pH and peroxide concentration was adjusted to those of formula 2. Solutions 6 and 7 were solution 5 after 7.5 and 24 hours respectively.

The results in Table 2, (like those in Table 1) demonstrate the problem, namely the deterioration in properties of the solutions, that the present invention solves.

The results show that for the solution 3 to 7 the Dmax values have fallen and for solutions 2 to 7 the Dmin values have risen. This shows the instability of the solutions.

EXAMPLE 3

Process Comparisons

Low silver (58 mg/m$^2$) color paper was exposed by a standard exposure and then processed using for runs 1 to 3 the solutions and process cycles given below. For runs 4 and 5 solutions of Formulae A and B were used. The color papers were then read with status A sensitometry and the Dmax and Dmin values recorded in Table 3. In runs 1 to 3 that are not according to the invention, the process steps were effected conventionally using baths.

In runs 4 and 5 the bleach/redox amplification step was carried out in the apparatus shown in the drawing and as described in Example 1.

Color Developer-amplifier Solution (Formula 3)

| component | amount |
|---|---|
| anti-calcium agent | 0.6 g/l |
| DTPA | 0.81 g/l |

-continued

| | |
|---|---|
| $K_2HPO_4.3H_2O$ | 40.0 g/l |
| potassium chloride | 0.45 g/l |
| potassium bromide | 1.5 mg/l |
| Hydroxylamine sulphate | 1.2 g/l |
| Catechol disulfonate | 0.3 g/l |
| color developing agent (CD-3) | 5.5 g/l |
| $H_2O_2$ (30% w/w solution) | 2.5 ml/l |
| pH | 11.5 |
| temperature | 35° C. |
| processing time | 45 seconds |
| Process cycle | |
| color developing with formula 3 | 45 seconds |
| stop | 45 seconds |
| bleach/fixing | 22.5 seconds |
| washing | 3 times for 22.5 seconds each |
| dry | |

Amplifier Solution (Formula 4)

| component | amount |
|---|---|
| anti-calcium agent | 0.6 g/l |
| DTPA | 0.81 g/l |
| $K_2HPO_4.3H_2O$ | 40.0 g/l |
| $H_2O_2$ (30% w/w solution) | 5 to 15 ml/l |
| pH | 11.4 |
| temperature | 35° C. |
| processing time | 10 seconds |
| Process cycle | |
| color developing with formula 3 | 25 seconds |
| amplifying with formula 4 | 10 seconds |
| KODAK Electrosilver fixer (100 ml/l) | 30 seconds |
| washing | 120 seconds |
| dry | |

KODAK is a Registered Trade Mark.

These results were obtained for the following processes with coatings of total silver laydown of 58 mg/m$^2$.

TABLE 3

| Run No | Process | Cyan Dmax | Magenta Dmax | Yellow Dmax | Cyan Dmin | Magenta Dmin | Yellow Dmin |
|---|---|---|---|---|---|---|---|
| 1 | devamp formula 3 | 2.57 | 2.30 | 2.15 | 0.09 | 0.111 | 0.112 |
| 2 | split dev formulas 1 and 2 | 2.14 | 2.19 | 1.97 | 0.103 | 0.115 | 0.109 |
| 3 | split dev. formulas 1 and 4 | 2.13 | 2.21 | 2.02 | 0.10 | 0.11 | 0.11 |
| 4 | invention formulas A and B. 8g/l of CD3 in developer | 2.59 | 2.40 | 2.07 | 0.09 | 0.118 | 0.09 |
| 5 | invention formulas A and B. 10 g/l CD3 in developer. | 2.39 | 2.59 | 2.11 | 0.09 | 0.113 | 0.08 |

Runs 4 and 5 are according to the invention.

Runs 1, 2 and 3 are included for comparison purposes.

The results show that when working according to the invention the values of Dmax and Dmin are more close to the values obtained using the color developer amplifier of Formula 3.

The process described in the above Examples has the following advantages:

1. The use of a small volume of bleach/redox amplifier solution which is discarded after use avoids the problem of unstable seasoned bleach/redox amplifier solution.

2. Continuous application of bleach/redox amplifier solution is easy and the web of photographic color paper is passed or pushed between the two sheets.

3. The bleach/redox amplifier flow can be turned off to conserve activity when not processing.

4. Start up volume is very small and of the order of 10 to 20 ml of bleach/redox amplifier.

5. The color developing agent content can be reduced from 10 to 8 g/l as the developing agent is captured between the paper surface and the plastic film sheet. This gives better utilization of color developing agent as it cannot escape to the bulk solution as in a tank.

6. The system is self lubricating.

7. The process can be fitted into large leader belt photofinishing machines, the paper clips would pass through between the sheets and reseal on the paper behind the clip due to surface tension. Carry over can be reduced as the leader belts would not need to pass through the sheets.

8. The system is easily cleaned by rinsing with water between the two sheets, an instant restart is then possible.

9. The sheets are a cheap and replaceable part if they should be damaged.

10. No Dmin occurs due to overnight stands as there is no seasoned solution retained overnight.

11. The sheets could be retrofitted inside existing tank designs.

12. Unstable solutions can be used between the sheets. This allows the removal of stabilizing chemicals and hence a more environmentally benign process effluent.

The invention has been described in detail with particular reference to certain preferred embodiments thereof, but it will be understood that variations and modifications can be effected within the spirit and scope of the invention.

I claim:

1. A process for forming a photographic image comprising the steps of:

A) color developing an imagewise exposed photographic material, and

B) combined bleaching and redox amplification of said photographic material, wherein said step B is carried out with a sample of a bleach/redox amplifying solution comprising hydrogen peroxide or a compound that releases hydrogen peroxide, said sample being applied only once to said photographic material in an amount of from about 20 to about 500 ml/$m^2$.

2. The process of claim 1 wherein said sample is applied to said photographic material at from about 30 to about 70 ml/$m^2$.

3. The process of claim 1 wherein said sample is applied to said photographic material by passing said photographic material between two sheets held together by the surface tension of said sample.

4. The process of claim 3 that is continuous and said sample is fed continuously to the gap between said two sheets.

5. The process of claim 3 wherein said photographic material is passed in a downward direction between said two sheets.

6. The process of claim 3 wherein step B is carried out for at least 5 seconds.

7. The process of claim 1 wherein said photographic material is a photographic color paper.

8. The process of claim 7 wherein said photographic material has a silver chloride emulsion.

9. The process of claim 8 wherein said photographic material has a silver chloride emulsion having 85 mol % silver chloride.

10. The process of claim 1 wherein said photographic material has a total of less than 130 mg of silver/$m^2$.

11. The process of claim 10 wherein said photographic material has a total of from about 20 to about 120 mg silver/$m^2$.

12. The process of claim 1 wherein said photographic material comprises a blue light sensitive emulsion layer having from about 20 to about 60 mg silver/$m^2$.

13. The process of claim 12 wherein said photographic material has a total of less than about 130 mg of silver/$m^2$, and further comprises a red light sensitive emulsion layer, and a green light sensitive layer, and said remaining silver is equally divided between said red light and green light sensitive emulsion layers.

14. The process of claim 1 wherein said bleach/redox amplifying solution has a pH of from about 10 to about 12.

15. The process of claim 14 wherein said bleach/redox amplifying solution has a pH of from about 10.5 to about 11.2.

16. The process of claim 1 wherein said bleach/redox amplifying solution further comprises a halide in an amount of from about 1 to about 35 g/l.

17. The process of claim 16 wherein said halide is chloride.

18. The process of claim 1 wherein said bleach/redox amplifying solution further comprises a hydrogen peroxide stabilizer.

19. The process of claim 1 wherein said bleach/redox amplifying solution further comprises a nonionic surfactant.

* * * * *